United States Patent [19]

Kim

[11] Patent Number: 4,780,398

[45] Date of Patent: Oct. 25, 1988

[54] BLEACHING COMPOSITION AND PROCESS FOR COLOR PHOTOGRAPHIC MATERIALS

[75] Inventor: Hongzoon Kim, Boonton, N.J.

[73] Assignee: Olin Hunt Specialty Products, Inc., Palisades Park, N.J.

[21] Appl. No.: 901,691

[22] Filed: Aug. 28, 1986

[51] Int. Cl.[4] ..... G03C 5/38

[52] U.S. Cl. ..... 430/461; 430/431; 430/460; 430/462

[58] Field of Search ..... 430/460, 461, 462, 431

[56] References Cited

U.S. PATENT DOCUMENTS

| | | | |
|---|---|---|---|
| 3,880,660 | 4/1975 | Ishihara et al. | 96/50 R |
| 3,893,858 | 7/1975 | Wabnitz, Jr. | 96/60 R |
| 4,040,837 | 8/1977 | Sakamoto et al. | 96/60 BF |
| 4,138,256 | 2/1979 | Fushiki et al. | 96/60 BF |
| 4,546,070 | 10/1985 | Kishimoto et al. | 430/393 |

FOREIGN PATENT DOCUMENTS 1138842 1/1969 United Kingdom ..

*Primary Examiner*—Paul R. Michl

*Assistant Examiner*—Mark R. Buscher

*Attorney, Agent, or Firm*—James B. Haglind

[57] ABSTRACT

A bleaching composition for color photographic materials consists essentially of an aqueous solution containing a complex of ferric ion and an aminopolycarboxylic acid or salt thereof; a mercapto-substituted 5-membered heterocyclic nitrogen compound having at least two nitrogen atoms; and a vinyl pyrrolidone polymer selected from the group consisting of poly-N-vinyl pyrrolidone and an alkyl-substituted poly-N-vinyl pyrrolidone.

Use of the novel bleaching composition in the bleaching process for color photographic materials results in a substantial reduction in bleaching time while preventing the formation of a precipitate during the process. Further, use of the bleaching composition and process permits a significant reduction in the amounts of bleaching agent and other components of the bleaching solution required where the bleaching time is not critical which results in a substantial cost reduction. In addition, the more complete silver removal achieved provides processed color photographic materials having improved quality.

25 Claims, No Drawings

BLEACHING COMPOSITION AND PROCESS FOR COLOR PHOTOGRAPHIC MATERIALS

This invention relates to the processing of color photographic materials. More particularly, this invention relates to the bleaching of light-sensitive silver halide color photographic materials.

In the process for color image formation on light-sensitive silver halide color photographic materials, the major chemical steps are as follows:

1. Development: reduction of exposed silver halide crystals to metallic silver accompanied by color dye formation.
2. Bleaching: oxidation of metallic silver to silver halide.
3. Fixing: complexing and removal of all silver halide from the photographic material.

The bleaching and fixing functions may be accomplished in one bath, called a bleach-fix or blix.

In addition to these steps, auxiliary steps may be used in actual practice to maximize image quality.

In general, there are many compounds known in the art that can be used as bleaching agents because of their strong oxidizing ability. However, in practice most of these have several strong disadvantages such as environmental hazards or toxicity, incompatibility with processing materials, etc. Most commonly used in practice today are the ferric salts of aminopolycarboxylic acids. However, these compounds, although having several advantages over other compounds, are relatively low in bleaching strength. This disadvantage leads to one or more of the following:

1. longer processing times;
2. necessity for using more concentrated bleaching baths;
3. inability to oxidize all metallic silver to the halide salt, thus leaving retained silver in the processed photographic material. This results in reduced color image quality.

To compensate for this, there are known to the art bleach-accelerating compounds which improve bleaching performance. Examples of these are compounds having a mercapto group or a disulfide bond, thiazolidine derivatives, and isothiourea derivatives. However, use of these compounds in bleaching baths has resulted in the formation of precipitates when color photographic materials are processed through the bath. This occurs particularly when color photographic materials are processed continuously and when the baths are recycled and reused.

Various attempts have been made to prevent the formation of precipitates during the bleaching or the bleaching-fixing steps of the color development process when using ferric salts of amino-polycarboxylic acids including the use of various types of additives.

U.S. Patent No. 3,893,858, issued July 8, 1975 to H. E. Wabnitz, Jr., teaches thiol compounds such as monothioglycerol, cysteine, and the use of aminoalkylenethiols as bleach accelerators in processing color photographic materials using aminopolycarboxylic acid bleaching agents.

Mercapto-substituted heterocyclic compounds such as mercaptotriazoles, mercaptoimidazoles, mercaptothiodiazoles, or mercaptotetrazoles are described as bleach-accelerating agents for color photographic processes which combined include a bleach-fixing bath, as described in British Patent No. 1,138,842, issued Jan. 1, 1969 to H. Meckl et al. The bleach-fixing baths include alkali metal sulfites, alkali metal thiosulfates, alkali metal phosphate compounds as well as other components.

Ferric ion complex salts are used in bleaching solutions, in combination with a dithiothiadiazole compound, and a compound having a mercapto group, or a disulfide bond, a thiazolidine derivative, or an isothiourea derivative, to prevent the formation of precipitates as described in U.S. Pat. No. 4,546,070, issued Oct. 8, 1985 to S. Kishimoto et al. The use of the dithiothiadiazole derivatives, however, adds considerable expense to the bleaching operation as the compounds are not available commercially.

An object of the present invention is to provide a composition for processing light-sensitive silver halide color photographic materials which results in reduced bleaching times while providing color photographic images of good quality without the formation of a precipitate in a bleaching solution containing a bleach-accelerating agent.

Another object of the present invention is to provide a method for continuously processing light-sensitive silver halide color photographic materials at reduced bleaching times while providing color photographic images of good quality without the formation of a precipitate in a bleaching solution containing a bleach-accelerating agent.

A further object of the present invention is to provide a composition and method for bleaching silver halide color photographic materials which is economically competitive.

These and other objects of the invention are accomplished by a bleaching composition for color photographic materials consisting essentially of an aqueous solution containing a complex of ferric ion and an aminopolycarboxylic acid or salt thereof; a mercapto-substituted 5-membered heterocyclic nitrogen compound having at least two nitrogen atoms; and a vinyl pyrrolidone polymer selected from the group consisting of poly-N-vinyl pyrrolidone and an alkyl-substituted poly-N-vinyl pyrrolidone.

More in detail, in the novel bleaching composition of the present invention a ferric ion complex bleaching agent is used. A ferric ion complex is a complex of ferric ion and a chelating agent such as an aminopolycarboxylic acid, or a salt thereof. Aminopolycarboxylic acid salts are alkali metal salts, ammonium salts or water-soluble amine salts. The alkali metals include sodium, potassium, lithium, etc., and water-soluble amines include alkylamines (e.g., methylamine, diethylamine, triethylamine, butylamine, etc.), alicyclic amines (e.g., cyclohexylamine), arylamines (e.g., aniline, m-toluidine, etc.), and heterocyclic amines (e.g., pyridine, morpholine, piperidine, etc).

Typical examples of these aminopolycarboxylic acid chelating agents are:

Ethylenediaminetetraacetic acid;
Alkali metal ethylenediaminetetraacetates;
Ammonium ethylenediaminetetraacetates;
Alkyl ammonium ethylenediaminetetraacetates;
Diethylenetriaminepentaacetic acid;
Alkali metal diethylenetriaminepentaacetates;
Ammonium diethylenetriaminepentaacetates;
Propylenediaminetetraacetic acid;
Alkali metal propylenediaminetetraacetates;
Cyclohexanediaminetetraacetic acid;

Alkali metal cyclohexanediaminetetraacetates;
Ammonium cyclohexanediaminetetraacetates;
Ethylenediaminetetrapropionic acid;
Phenylenediaminetetraacetic acid; and mixtures thereof.

The aqueous solution containing the above-described ferric ion complex may further contain complexes of other metals than iron such as cobalt or copper.

The aqueous solution according to the present invention further contains as re-halogenating agents alkali metal and ammonium halides such as bromides (e.g. potassium bromide, sodium bromide, ammonium bromide, etc.); chlorides (e.g., potassium chloride, sodium chloride, ammonium chloride, etc.), iodides (e.g., sodium iodide or potassium iodide chloride, etc.); and mixtures thereof, in addition to the ferric ion complex.

Further, additives which have a pH-buffering ability such as inorganic acids, organic acids, or the salts thereof and which are known to be used in ordinary bleaching solutions (e.g., boric acid, borax, sodium metaborate, acetic acid, sodium acetate, nitric acid, phosphoric acid, sodium phosphate, citric acid, sodium citrate, tartaric acid, etc.) may be added.

The concentration of the ferric ion complex employed is not critical and can vary, for example, from about 0.1 to about 2 mols per liter of the aqueous solution. The pH of the aqueous solution is desirably maintained at from about 3.0 to about 8.0, particularly from about 4.0 to about 7.0.

To reduce the time required for bleaching the second ingredient of the novel composition is a bleach-accelerating compound. The bleach-accelerating compound is admixed with the bleaching solution. Suitable bleach accelerators include mercapto-substituted 5-membered heterocyclic compounds having at least two nitrogen atoms such as mercaptothiadiazoles, mercaptotriazoles, mercaptotetrazoles, mercaptoimidazoles, and mercaptoimidazolines. Of these mercapto-substituted heterocyclic compounds, preferred are those having more than two nitrogen atoms in the heterocyclic ring structure, for example, mercaptotriazoles including mercapto-1,2,3-triazoles, mercapto-1,2,4-triazoles, and mercapto-1,2,3,4-tetrazoles, with mercapto-1,2,4-triazoles being more preferred. The bleaching solution contains any suitable amount of the bleach-accelerating compound, for example, those in the range of from about 0.01 to about 10, and preferably from about 0.3 to about 5 grams per liter.

To prevent the formation of a precipitate during the bleaching step for color photographic materials the third ingredient of the novel composition is a vinyl pyrrolidone polymer. Suitable vinyl pyrrolidone polymers include poly-N-vinyl pyrrolidone and alkyl-substituted poly-N-vinyl pyrrolidones which are soluble or readily dispersed in water. The poly-N-vinyl pyrrolidones suitable as additives have an average molecular weight of from about 1,000 to about 70,000 and are used in amounts of from about 0.05 to about 20, preferably from about 0.1 to about 10, and more preferably from about 0.5 to about 4 grams per liter. Preferred as additives are alkyl-substituted poly-N-pyrrolidones.

In accordance with the novel process of the invention, the foregoing composition is employed in the bleaching of color photographic materials. The bleaching process is carried out at temperatures commonly employed and the process of the present invention is carried out in the absence of fixing agents or stabilizing agents.

Following the bleaching step, the bleached color photographic materials may be processed in further steps such as water washing, fixing, or stabilizing using known fixing and stabilizing solutions and procedures.

Use of the novel bleaching composition in the bleaching process for color photographic materials results in a substantial reduction in bleaching time while preventing the formation of a precipitate during the process. Further, use of the bleaching composition and process permits a significant reduction in the amounts of bleaching agent and other components of the bleaching solution required where the bleaching time is not critical which results in a substantial cost reduction. In addition, the more complete silver removal achieved provides processed color photographic materials having improved quality.

The present invention is further illustrated by the following examples:

EXAMPLES 1-5

Pre-exposed rolls of 35 mm color negative film having 36 exposures per roll (Kodak ISO 1000 and 400) were developed in Olin Hunt Negacolor TM -2 developing solution for a period of 3.25 minutes. The developed films were then processed thru 360 mls of a bleaching bath containing a ferric salt of ethylenediamine tetraacetic acid (Olin Hunt Negacolor TM -2 bleach solution) to which was added 0.3 grams per liter of 3-mercapto-1,2,4-triazole as a bleach accelerator. To prevent the formation of a precipitate in the bleach solution, various concentrations of poly-N-vinyl-pyrrolidone (PVP K-15 MW 10,000-GAF corp.) and alkyl substituted poly-N-vinyl pyrrolidone (Ganex ®P-904 - GAF Corp.) were added to the bleach solution. Following bleaching, the rolls were processed for (4'20") in a fixing bath containing Olin Hunt Universal and Electrolytic Color Fixer solution. After fixing, the rolls were washed in water (3'15") and stabilized in Olin Hunt Negacolor TM stabilizer (1'30"). The developing, bleaching, fixing, washing, and stabilizing solutions were each maintained at 38° C. during processing. The formation of a precipitate was observed with the naked eye and the results are given in TABLE I below.

TABLE I

| Example No. | Poly-N—Vinyl pyrrolidone (g/l) | Alkyl-Substituted poly-n-vinyl pyrrolidone (g/l) | No. Film rolls bleached | Results |
|---|---|---|---|---|
| Control | — | — | 4 | Heavy precipitate formation |
| 1 | 1.0 | — | 10 | Cloudy |
| 2 | 2.0 | — | 16 | Clear but precipitate formed overnight |
| 3 | — | 1.0 | 16 | Clear (slightly cloudy) |
| 4 | — | 1.5 | 16 | Clear - no precipitation |
| 5 | — | 2.0 | 16 | Clear - no precipitation |

EXAMPLE 6

Commercially available color negative films of ISO 100 manufactured by Kodak, Agfa-Gevaert, and Fuji were imagewise exposed to light and subjected to the color developing process employed in EXAMPLES 1–5. Equal amounts (341.5 grams per liter) of the Olin Hunt Negacolor TM -2 bleach solution and the Olin Hunt Negacolor TM -2 bleach solution containing 0.3 g/l 3-mercapto-1,2,4-triazole and 1 g/l of poly-N-vinyl pyrrolidone (PVP K-15, GAF Corp.) were employed in the bleaching step. Bleaching times were measured and the effectiveness of the bleaching solution determined by detecting the retained metallic silver in the film using an infrared scope. The results are summarized as follows:

| Bleach Solution | Avg. Bleaching Time (Min) | Ag retention |
|---|---|---|
| Olin Hunt Negacolor TM | 4'20" | slight |
| Bleach Solution of the invention | 3'00 | none |

What is claimed is:

1. A bleaching composition for color photographic materials consisting essentially of an aqueous solution containing a complex of ferric ion and an aminopolycarboxylic acid or salt thereof; a mercapto-substituted 5-membered heterocyclic nitrogen compound having at least two nitrogen atoms; and a vinyl pyrrolidone polymer selected from the group consisting of poly-N-vinyl pyrrolidone and an alkyl-substituted poly-N-vinyl pyrrolidone.

2. The bleaching composition of claim 1 which contains as a re-halogenating agent, an alkali metal halide, or an ammonium halide, where the halide is selected from the group consisting of bromide, chloride, iodide, and mixtures thereof.

3. The bleaching composition of claim 1 in which the vinyl pyrrolidone polymer has a molecular weight of from about 1,000 to about 70,000.

4. The bleaching composition of claim 1 in which the mercapto-substituted 5-membered heterocyclic nitrogen compound is selected from the group consisting of mercaptotriazoles, mercaptotetrazoles, mercaptothiadiazoles, mercaptoimidazoles, and mercaptoimidazolines.

5. The bleaching composition of claim 1 in which the aminopolycarboxylic compound acid is selected from the group consisting of ethylenediaminetetraacetic acid, alkali metal ethylenediaminetetraacetates, and ammonium ethylenediaminetetraacetate.

6. The bleaching composition of claim 1 in which the amount of vinyl pyrrolidone polymer is from about 0.05 to about 20 grams per liter.

7. The bleaching composition of claim 4 in which the mercapto-substituted 5-membered heterocyclic nitrogen compound is a mercaptotriazole.

8. The bleaching composition of claim 6 in which the vinyl pyrrolidone polymer is poly-N-vinyl pyrrolidone.

9. The bleaching composition of claim 6 in which the vinyl pyrrolidone polymer is an alkylsubstituted poly-N-vinyl pyrrolidone.

10. The bleaching composition of claim 4 in which the amount of mercapto-substituted 5-membered nitrogen heterocyclic compound is from about 0.01 to about 5 grams.

11. The bleaching composition of claim 10 in which the mercaptotriazole is 3-mercapto-1,2,4-triazole.

12. The bleaching composition of claim 11 in which the amount of vinyl pyrrolidone polymer is from about 0.1 to about 10 grams per liter.

13. The bleaching composition of claim 12 in which the vinyl pyrrolidone polymer has a molecular weight of from about 1,000 to about 70,000.

14. The bleaching composition of claim 13 in which the vinyl pyrrolidone polymer is a water soluble alkyl-substituted poly-N-vinyl pyrrolidone.

15. The bleaching composition of claim 14 in which the amount of alkyl-substituted poly-N-vinyl pyrrolidone is from about 0.5 to about 4 grams per liter.

16. In a bleaching composition for color photographic materials containing a complex of ferric ion and an aminocarboxylic acid or salt thereof the improvement which comprises including a mercapto-substituted 5-membered heterocyclic nitrogen compound having at least two nitrogen atoms and a vinyl pyrrolidone polymer selected from the group consisting of poly-N-vinyl pyrrolidone and alkyl-substituted poly-N-vinyl pyrrolidone.

17. The bleaching composition of claim 16 in which the aminopolycarboxylic compound acid is selected from the group consisting of ethylenediaminetetraacetic acid, alkali metal ethylenediaminetetraacetates, and ammonium ethylenediaminetetraacetate.

18. The bleaching composition of claim 17 in which the mercapto-substituted 5-membered heterocyclic nitrogen compound is a mercaptotriazole.

19. The bleaching composition of claim 1 in which the vinyl pyrrolidone polymer has a molecular weight of from about 1,000 to about 70,000 and is readily dispersed or soluble in water.

20. The bleaching composition of claim 19 in which the vinyl pyrrolidone polymer is poly-N-vinyl pyrrolidone.

21. The bleaching composition of claim 19 in which the vinyl pyrrolidone polymer is an alkylsubstituted poly-N-vinyl pyrrolidone.

22. The bleaching composition of claim 4 in which the amount of mercaptotriazole is from about 0.01 to about 5 grams.

23. The bleaching composition of claim 22 in which the amount of vinyl pyrrolidone polymer is from about 0.1 to about 10 grams per liter.

24. A method for bleaching light-sensitive silver halide color photographic materials which comprises contacting the photographic materials with an aqueous bleaching solution consisting essentially of a complex of ferric ion and an aminopolycarboxylic acid compound, a mercapto-substituted 5-membered heterocyclic nitrogen compound having at least two nitrogen atoms, and a vinyl pyrrolidone polymer selected from the group consisting of poly-N-vinyl pyrrolidone and alkyl-substituted poly-N-vinyl pyrrolidone.

25. The method of claim 24 in which the pH of the aqueous solution is from about 3.0 to about 8.0.

* * * * *